United States Patent [19]

Cashdollar, Sr.

[11] 4,062,397

[45] Dec. 13, 1977

[54] PROTECTION AGAINST OXIDATION OF MOLTEN METAL STREAMS IN CONTINUOUS CASTING

[76] Inventor: Robert E. Cashdollar, Sr., 890 New Castle Road, Butler, Pa.

[21] Appl. No.: 667,395

[22] Filed: Mar. 16, 1976

[51] Int. Cl.[2] ..... B22D 11/10

[52] U.S. Cl. ..... 164/415; 266/236

[58] Field of Search ..... 164/66, 259, 273 R, 164/273 M, 281; 266/236

[56] References Cited

U.S. PATENT DOCUMENTS

| | | | |
|---|---|---|---|
| 3,399,715 | 9/1968 | Harders et al. | 164/66 |
| 3,439,735 | 4/1969 | Holmes | 164/259 |
| 3,545,529 | 12/1970 | Keene | 164/66 X |
| 3,563,299 | 2/1971 | Schroge | 164/66 X |
| 3,572,422 | 3/1971 | Lyman | 164/259 X |
| 3,700,026 | 10/1972 | Adochi et al. | 164/259 X |
| 3,833,050 | 9/1974 | Kashuba et al. | 164/66 X |
| 3,921,704 | 11/1975 | Tozoki | 164/259 |

*Primary Examiner*—Ronald J. Shore
*Attorney, Agent, or Firm*—Hymen Diamond

[57] ABSTRACT

A shroud for enshrouding, in a shield of anti-oxidation gas, the molten stream which flows from the tundish into the mold and/or from the ladle into the tundish of continuous casting apparatus. The shroud includes a platform from which there extends a projection having the shape of a frustrum of a circular cone terminating in a circular opening. The shroud is formed from a plate having an opening therein by hydraulically deep drawing the material around the opening. A nipple is provided in the projection for injecting the anti-oxidation gas. In contrast to the flow of the gas in the use of prior-art shrouds, the gas, in the practice of this invention, flows in a helical or cyclonic path about the molten stream and effectively protects the stream against oxidation.

1 Claim, 10 Drawing Figures

FIG.5
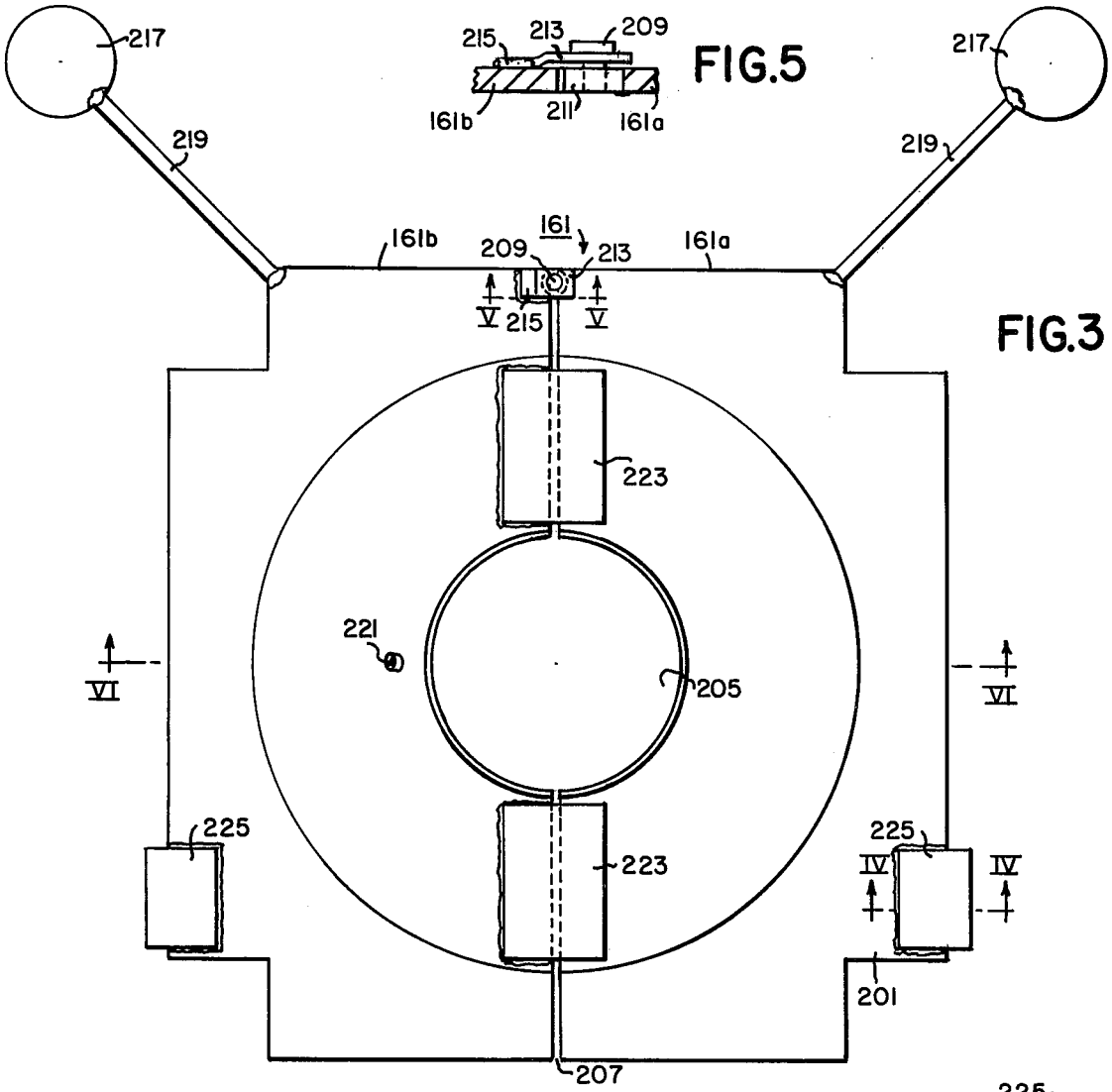
FIG.3
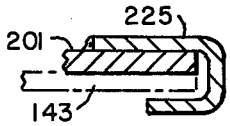
FIG.4
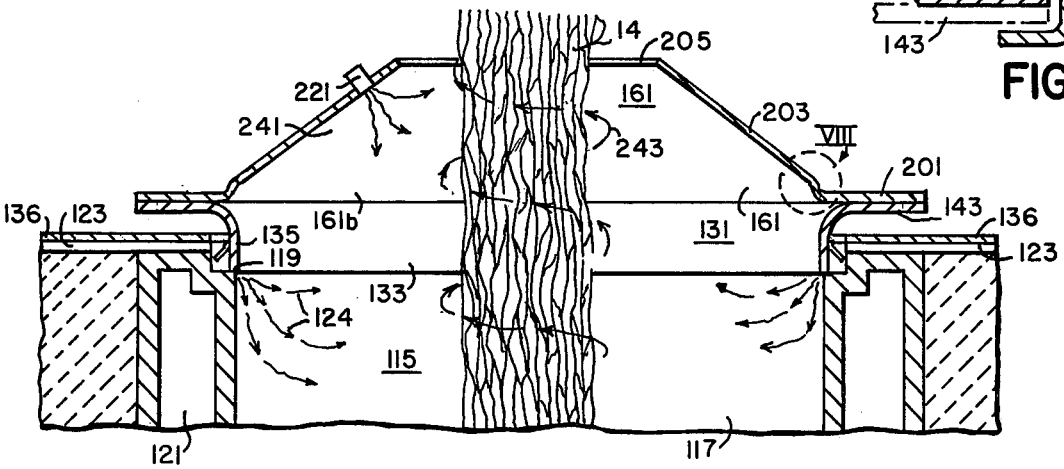
FIG.6

FIG.7
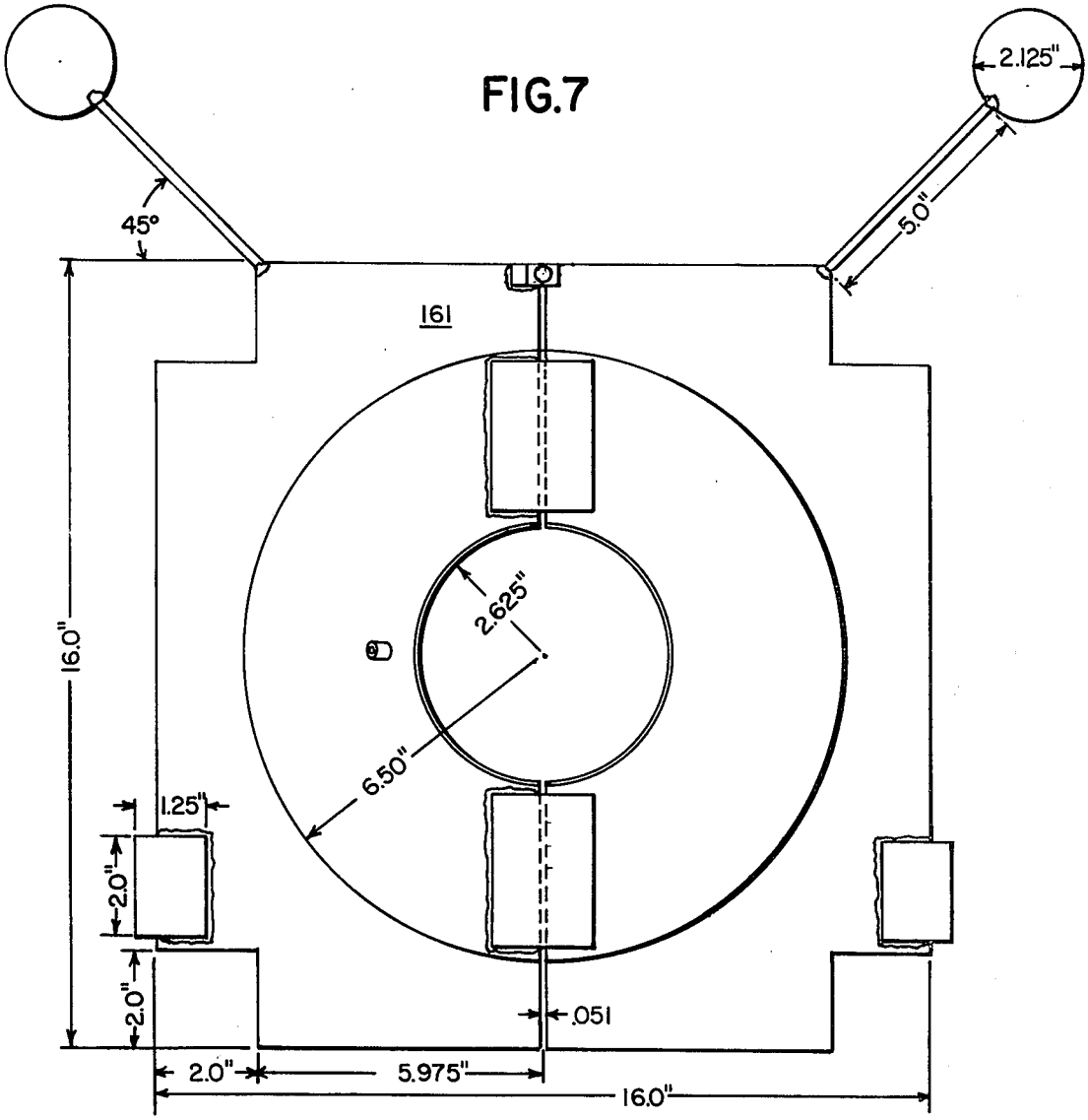
FIG.8
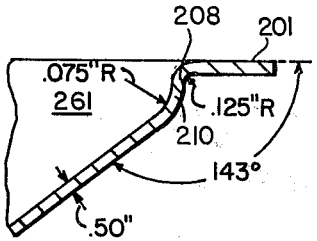
FIG.9
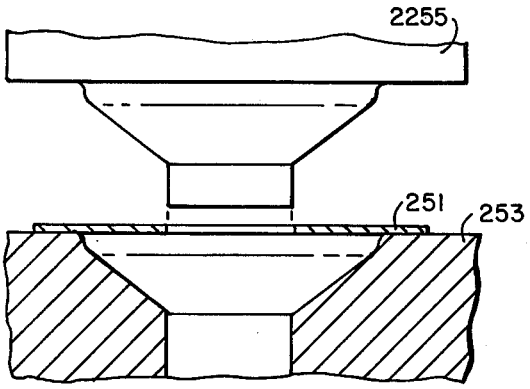
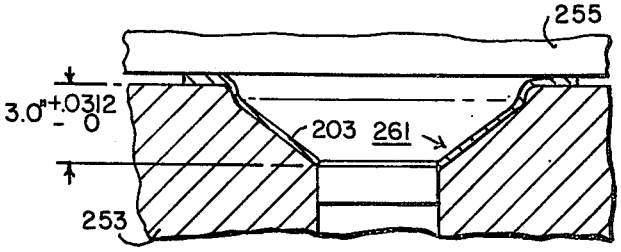
FIG. 10

PROTECTION AGAINST OXIDATION OF MOLTEN METAL STREAMS IN CONTINUOUS CASTING

REFERENCE TO RELATED APPLICATIONS

Application Ser. No. 654,867 filed Feb. 3, 1976, to Robert E. Cashdollar, Sr. for Continuous Casting is incorporated herein by reference.

BACKGROUND OF THE INVENTION

This invention relates to continuous casting, typically to continuous casting of steel. It has particular relationship to the shielding, by a gas for deoxidation purposes, of the stream of molten metal which flows from the tundish to the mold or from the ladle to the tundish (Cashdollar U.S. Pat. No. 3,754,590). The anti-oxidation gas shields the molten metal in the stream from the oxygen in the air or reacts with the oxygen. Typical deoxidation gases include non-reactive gases which serve for shielding and are the inert gases, such as helium, argon, neon or krypton and such gases as nitrogen. Another practice is to admit natural or artificial gas (methane) into the region to be protected and consuming the oxygen by burning the gas. As used in this application, the expression "anti-oxidation gas" means an inert gas or such gases as nitrogen or any mixture of these gases or gases which absorb the oxygen by reaction.

In accordance with the teachings of the prior art, attempts have been made to use for a shroud a pipe having a polygonal, particularly square, cross-section. This structure has in practice proven useless. Attempts have also been made to provide a shroud in the form of a platform or plate from which there projects a four-sided pyramid, terminating in a square or rectangular opening. This shroud is costly. Its manufacture has high labor cost because it is necessary to form the plates which constitute the sides of the pyramid and then secure them, by welding, to the base plate and to each other to form the pyramid. In addition, in practice this pyramid shroud has been found to be ineffective.

It is an object of this invention to overcome the above disadvantages of the prior art and to provide a shroud which shall effectively shield or otherwise protect from oxidation the metal stream of continuous casting apparatus either between the tundish and the mold or between the ladle and the tundish and shall also be capable of being manufactured at low cost. It is also an object of this invention to provide a method for making such a low-cost shroud.

SUMMARY OF THE INVENTION

This invention arises from the realization that the prior-art shroud is ineffective because the shielding or oxidizable gas is emitted from the opening in the shroud in linear or laminar streams and to an extent maintains the linearity as it flows along the molten-metal stream. Such gas flow is readily penetrated by the air. In accordance with this invention, a shroud is provided which not only transmits the anti-oxidation gas so that it effectively shields the molten-metal stream; but in addition, is manufactured at a relatively low cost. In the practice of this invention the shroud includes a plate or platform from which there extends a projection in the form of a frustrum of a cone terminating in a circular opening. The gas which is emitted from this projection cyclones about the molten-metal stream in a helical path which is not readily penetrated by the air. This shroud is formed at a low cost, from a plate having a hole, by deep drawing the material about the hole.

Another aspect of this invention arises from the necessity that for many, but not all, purposes the shroud be formed so that it can be opened to afford access for lancing the metal as it enters the mold. For this purpose the prior-art shroud is formed of two separate parts which are hinged. The joints between these parts is along the base of one of the sides of the pyramid. The two parts are then of different dimensions and are joined unsymmetrically. In accordance with this invention, after the deep drawing, the plate or platform, from which the frustrum extends, and the frustrum are severed along a central line through the plate and frustrum and then hinged along this line. The hinged parts are symmetrical. The application of this invention to the top of a tundish, may not require it to be cut as aforesaid for accessability.

BRIEF DESCRIPTION OF THE DRAWINGS

For a better understanding of this invention, both as to its organization and as to its method of operation, together with additional objects and advantages thereof, reference is made to the following description taken in connection with the accompanying drawings, in which:

FIG. 3 is a plan view of the shroud in accordance with this invention;

FIG. 4 is a fragmental view in section taken along line IV—IV of FIG. 3;

FIG. 5 is a fragmental view in section taken along line V—V of FIG. 3;

FIG. 6 is a fragmental view in section taken along line VI—VI of FIG. 3 and showing the relationship between the shroud according to this invention, and the mold, the mold cover and the stream of molten metal;

FIG. 7 is a view similar to FIG. 3 but showing typical dimensions of a shroud in accordance with this invention;

FIG. 8 is a fragmental view in section of the portion of the shroud in circle VIII of FIG. 6; and FIGS. 9 and 10 illustrate the steps in the formation of the shroud in the practice of this invention.

The dimensions shown in FIGS. 7, 8 and 10 are of a typical shroud in accordance with this invention and are included for the purpose of aiding those skilled in the art in practicing this invention and not with any intention of in any way restricting this invention. These dimensions will of course vary with the dimensions and structure of the continuous casting apparatus and of the mold or molds or tundish and ladle which it includes.

DETAILED DESCRIPTION OF INVENTION

Figure 1:
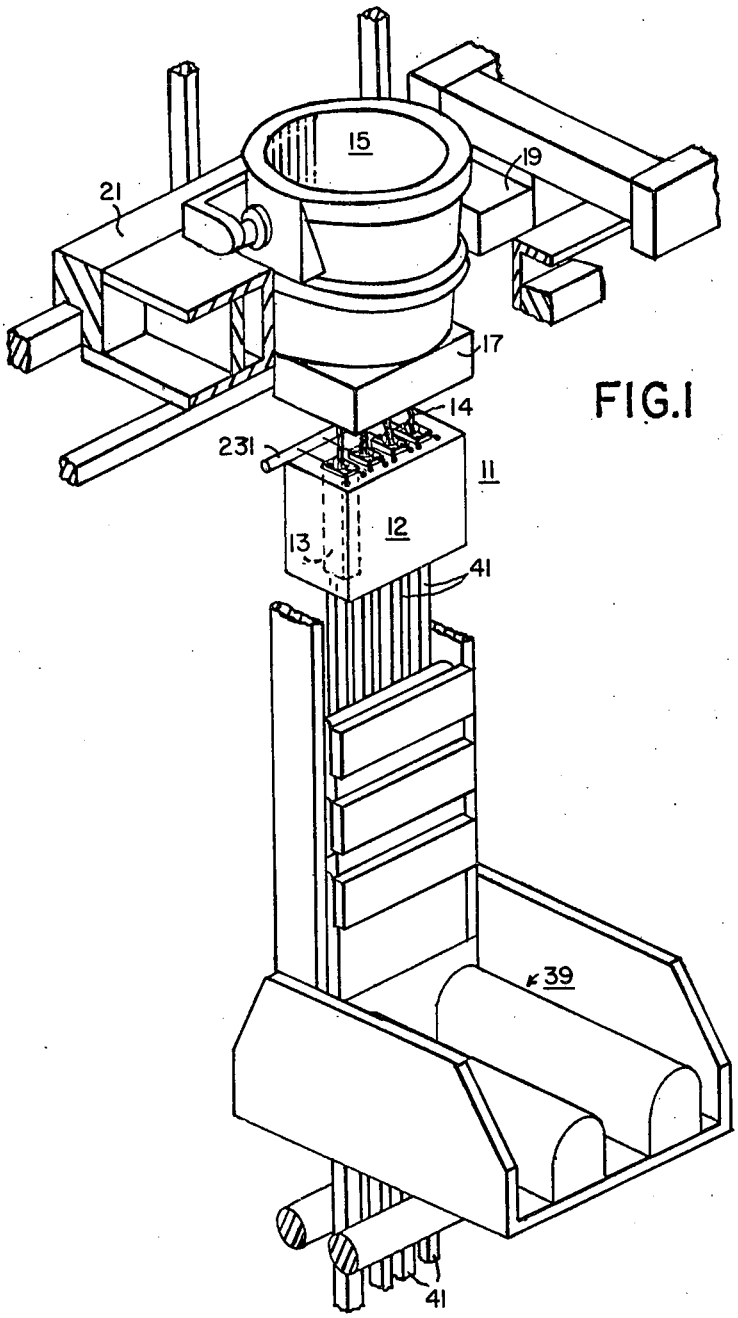
FIG. 1 is a view in perspective showing continuous casting apparatus in accordance with this invention.
Figure 2:
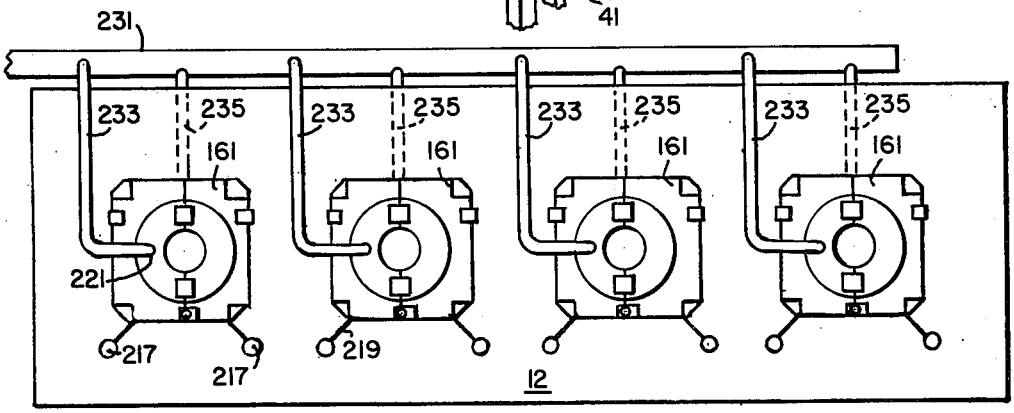
FIG. 2 is a plan view of the mold unit of the apparatus shown in FIG. 1 including the shroud.

FIGS. 1 and 2 show typical continuous casting apparatus 11. In this apparatus the shroud is shown as applied to provide anti-oxidation protection for the molten-metal stream between the tundish and the molds. This apparatus includes a mold unit 12 including a plurality of chill molds 13 into which a plurality of streams 14 of molten steel are poured from ladle 15 through tundish 17. Where there are a plurality of molds 13 in the unit 12 the tundish 17 has a plurality of openings. The ladle 15, typically containing about 200 tons more or less of molten steel, which is delivered from the basic oxygen furnace shop to the casting apparatus 11. To maintain the casting line in continuous operation, one large ladle 15 or two or more ladles 15 in rotation are typically delivered. Each ladle 15 may be subjected to degasing by vacuum degasing units (not shown) and is then lifted in a hoist (not shown) onto a bracket 19 in a ladle-positioning car 21 over a tundish 17 or is hoisted directly over a tundish 17 disposed above continuous casting lines. Where one ladle 15 is used the lines are usually started anew for each ladle; where two or more ladles in rotation are used the lines run continuously.

The mold unit 12 is a generally rectangular block, typically of steel, within which there are copper, water-cooled molds 13. Each mold includes a cavity 115 (FIG. 6). The cavity 115 may take different forms but typically it is in the form of an elongated rectangular parallelepiped typically of square horizontal cross section. The cavity 115 is defined by walls 117 which, at the opening to the cavity 115, have shoulders 119 that are ground to a fine finish and are burr free and warp free. The walls 117 are enclosed in a jacket 121 through which coolant flows. Near the top of the opening to the cavity 115, the jacket 121 and the walls 117 are penetrated by perforations 123 through which lubricant, typically rapseed oil, is injected. There are also like holes 123 for the injection into the mold of non-reactive gas (or conceivably oxidation gas) 124. This injection of gas is sometimes dispensed with.

At the start of a casting operation the cavity 115 is sealed at the bottom by a starter stool (not shown) which is engaged by a sealing mechanism (not shown). A coupling mechanism (not shown) is sealed through the starter stool. Each coupling mechanism includes an attenuated member (not shown), which extends into the cavity 115 and serves as chill rod, and a coupling member which extends from the starter stool and is grasped by a coupling device (not shown) and advanced to pinch rolls 39 which move the solidified steel strip 41 at the desired casting rate.

Each mold 13 has a cover 131 of FIG. 6. The cover 131 is of generally rectangular form having an opening 133 from whose boundary a stem 135 extends. The cover 131 is disposed over the mold 13 with the opening 133 coextensive with the opening in the mold 13. The stream 14 of molten metal flows into the cavity 115 through the opening 133 and the opening in the mold 13. The stem 135 rests on the shoulders 119 with its top 143 extending over the top 136 of the jacket 121. The mold cover 131 supports the shroud 161.

The shroud 161 includes a plate or platform 201 from which a frustrum 203 of a cone extends. The frustrum 203 terminates in a circular opening 205. The shroud 161 is formed of two generally like parts **161*a* and 161*b* which, in the operative position of the shroud, are engaged along a joint 207. The halves 161*a* and 161*b* of the frustrum 203 extend integrally from their corresponding halves of the platform 201. The junction between the platform 201 and the frustrum is generally S-shaped having a fillet 208 (FIG. 8) of small diameter between the platform 201 and the adjacent edge of the frustrum 203 and a fillet 210 of larger diameter between this edge and the remainder of the frustrum. This junction reduces deformation of the shroud 161 by the heat of the metal being cast and also as a result of rough handling. The halves 161*a* and 161*b* of the shroud 161 are pivoted on a readily removable pin 209 which is centered along the joint between the halves 161*a* and 161*b*. The pin 209 is held in a washer 211 (FIG. 5) which is welded into a groove in half 161*a* and penetrates into a groove in the half 161*b* and in a washer 213 which extends, from a projection 215 welded to the half 161*b*, over the washer 211. The halves 161*a* and 161*b* are pivotal between the closed and the open positions by manipulation of knobs 217 extending from arms 219 welded to the halves 161*a* and 161*b*. The knobs 217 and arms 219 may also be used to remove the shroud in the event of an abort. The half-frustrum of the half 161*b* is provided with a nipple 221 which is welded about an opening in the frustrum. Plates 223 extend across a portion of the joint 207** for reducing the penetration of air through the joint.

The shroud 161 is held on the mold cover 131 by brackets 225 of J cross-section (FIG. 4). The leg of each bracket is welded to the platform 201 and the loop extends below the platform engaging the base 143 of the mold cover.

The manifold 231 (FIG. 2) for transmitting the shielding or oxidizing gas is provided. Conductors 233 are connected between this manifold 231 and nipples 221 of the shrouds 161 for supplying the gas to the shrouds 161. Additional conductors 235 are connected between the manifold 231 and the openings 133 for supplying shielding or oxidizing gas to the mold cavity 115. For each mold 13 there are plurality of such conductors 235.

It has been found that as the shielding or oxidizing gas enters the region 241 (FIG. 6) under the shroud 161 it is caused, by the intense heat of the molten metal, to cyclone helically upwardly about the stream 14 as represented by the arrows 243. The gas injected into the mold cavity 115 also flows upwardly increasing the density of the gas around the stream 14. The cyclonic flow of gas is effective in preventing the penetration of air into the stream 14. The shroud 161 can be readily opened for lancing of the stream 14 or the metal solidifying in cavity 115 and it can readily be entirely removed by manipulation of the knobs 217.

The shroud 161 is formed at a low cost from a plate 251 (FIG. 9) having an opening therein by deep drawing. The plate 251 is appropriately positioned over the female part 253 of a die and the frustrum 203 is drawn by the compression exerted by the male part 255 of the die as illustrated in FIG. 10. The male part 255 is hydraulically actuated. Once the frustrum is drawn the resulting body 261 is severed to provide the parts **161*a* and 161*b* and the washers 211 and 213-215 are welded to the parts 161*a* and 161*b***.

While a preferred embodiment of this invention has been disclosed herein, many modifications thereof are possible. This invention is not to be limited except as is necessitated by the spririt of the prior art.

I claim:

1. For use with continuous-casting apparatus including a mold, means for delivering a stream of molten metal to said mold and means for deriving from said mold a continuous strip, a shroud for enshrouding said stream of molten metal in a protective anti-oxidation gas, the said shroud including a platform from which a projection in the form of a frustrum of a cone extends, said frustrum terminating in a generally circular opening, said shroud to be mounted on said apparatus with said projection generally coaxial with said stream, and means on said frustrum for injecting said gas therein, said shroud being in at least two parts engageable along a joint therebetween and including pivot means connecting said parts about which said parts are pivotal relative to each other and said shroud also including gas-shielding plates extending over the joint between said parts.

* * * * *